United States Patent [19]

Hall

[11] 4,375,111

[45] Mar. 1, 1983

[54] CONVERTIBLE MAT AND CARRYING BAG COMBINATION

[76] Inventor: Norman R. Hall, 1914 Shamrock Ave., Dupont Heights, Md. 20027

[21] Appl. No.: 192,029

[22] Filed: Sep. 29, 1980

Related U.S. Application Data

[63] Continuation-in-part of Ser. No. 70,979, Sep. 6, 1979, abandoned.

[51] Int. Cl.[3] ..... A47G 9/06; A45C 9/00

[52] U.S. Cl. ..... 5/419; 5/420; 150/12; 190/2

[58] Field of Search ..... 5/419, 420, 417, 418, 5/460; 150/12; 190/2

[56] References Cited

U.S. PATENT DOCUMENTS

| | | | |
|---|---|---|---|
| 1,951,527 | 3/1934 | Oas | 5/417 |
| 2,045,784 | 6/1936 | Leve | 5/419 |
| 2,099,427 | 11/1937 | Karr | 5/411 |
| 2,264,471 | 12/1941 | Glenn | 5/419 |
| 2,783,473 | 3/1957 | Humpeler | 5/417 |
| 2,870,464 | 1/1959 | Lalick | 5/420 |
| 3,041,638 | 7/1962 | Lo Vico | 5/419 |
| 3,226,737 | 1/1966 | Rote | 5/417 |
| 3,976,113 | 8/1976 | Kim | 5/417 |
| 4,068,786 | 1/1978 | Taniguchi | 5/419 |
| 4,136,412 | 1/1979 | Wilhelm | 5/417 |
| 4,154,323 | 5/1979 | Sneider | 5/417 |
| 4,195,378 | 4/1980 | Parker | 5/419 |
| 4,197,891 | 4/1980 | Comollo | 150/12 |
| 4,200,942 | 5/1980 | Case | 5/419 |

FOREIGN PATENT DOCUMENTS

| | | | |
|---|---|---|---|
| 28323 | 10/1931 | Australia | 5/419 |
| 761135 | 1/1934 | France | 5/419 |
| 1044391 | 11/1953 | France | 5/419 |

*Primary Examiner*—Alexander Grosz

*Attorney, Agent, or Firm*—Cushman, Darby & Cushman

[57] ABSTRACT

A convertible beach mat is provided that is lightweight, easy to fold up for transport, and bacteria-resistant. An inflatable head is connected to a body portion, and straps are associated with the corners of the head and body portions to releasably hold a towel covering the body portion alone, or both the body and head portions. The mat also is formed in combination with a carrying bag, one of the walls of the carrying bag being formed by a portion of the mat adjacent one corner of the mat. A pocket outside of the volume of the bag that contains the mat is formed with one wall of the mat for transporting accessory items.

6 Claims, 5 Drawing Figures

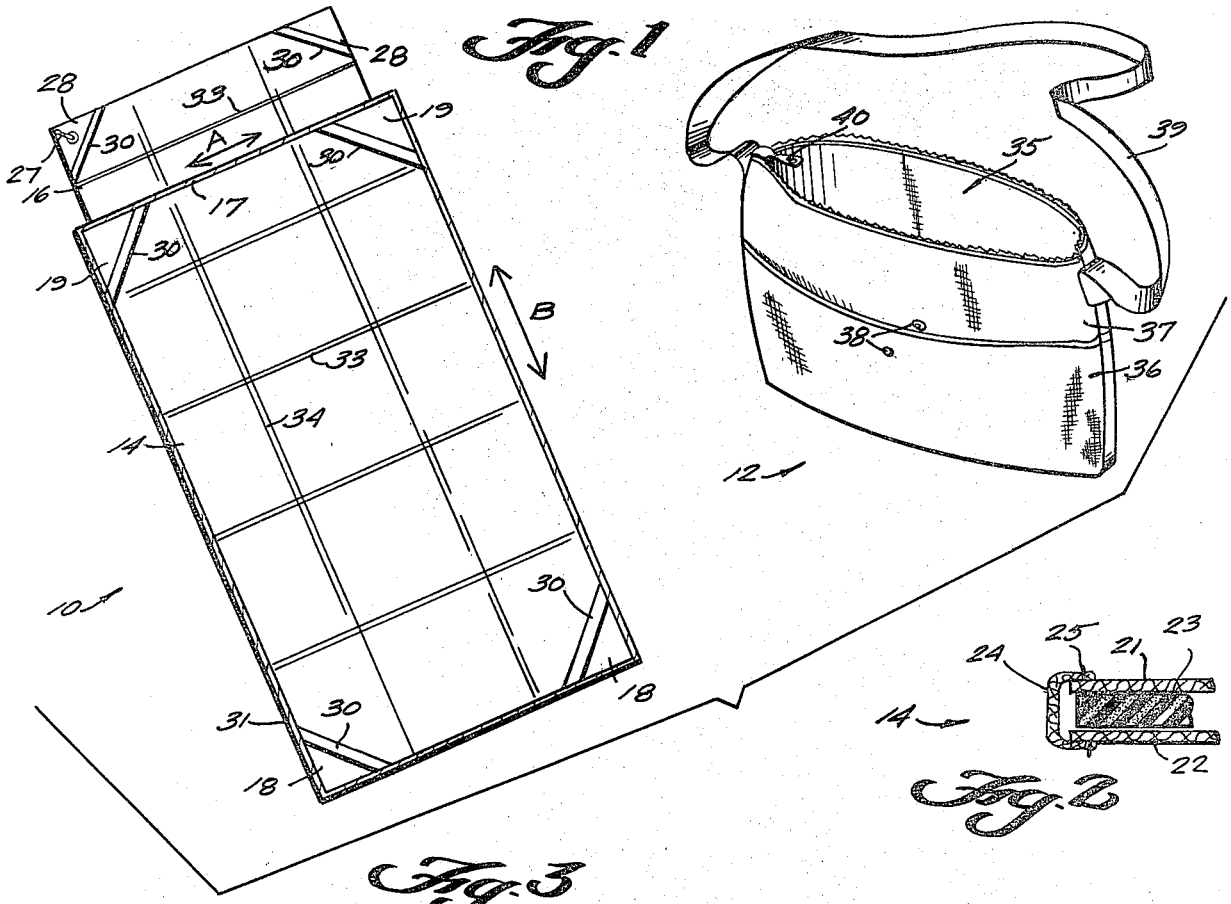
Fig. 1
Fig. 2
Fig. 3
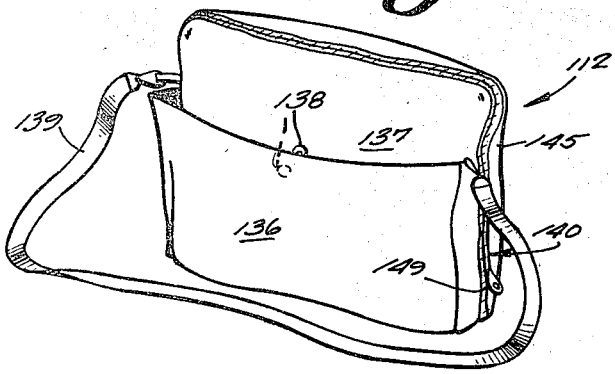
Fig. 4
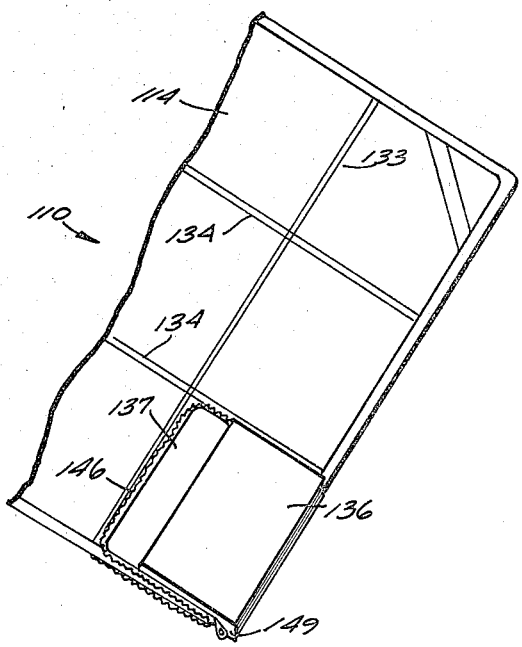
Fig. 5
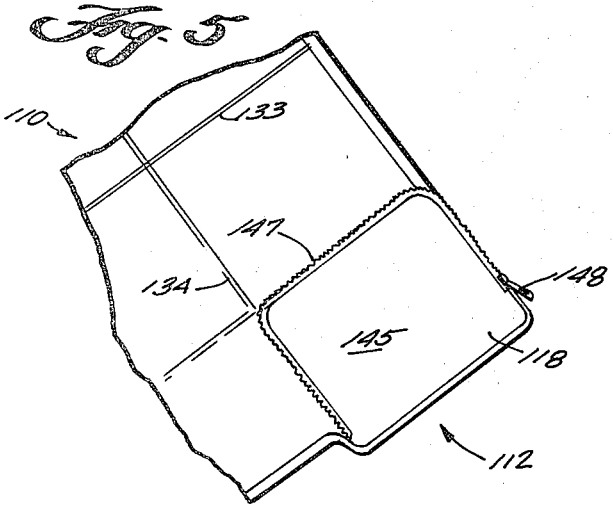

CONVERTIBLE MAT AND CARRYING BAG COMBINATION

CROSS-REFERENCE TO RELATED APPLICATIONS

This application is a continuation-in-part of my application Ser. No. 70,979, filed Sept. 6, 1979, now abandoned (the disclosure of which is hereby incorporated by reference herein).

BACKGROUND AND SUMMARY OF THE INVENTION

The invention relates to a device that is constructed to facilitate comfort and convenience when sunbathing and to facilitate movement to and from a sunbathing area or the like. The invention is particularly useful to facilitate enjoyment of a day at the beach, and overcomes the number of logistical problems often associated with a trip to and stay at the beach.

According to the present invention, a convertible mat is provided that is easy to transport (being readily foldable and lightweight), and which will support no bacterial life, yet will provide excellent comfort and versatility. The mat includes a body portion that is generally quadrate in plan, having four corners, each formed by substantially perpendicular edges, and being elongated (and foldable) in first and second substantially perpendicular dimensions of elongation. The body portion may comprise first and second layers of nylon, or materials having properties similar to nylon, sandwiching a thin layer of plastic foam therebetween, with stitching being provided on the edges to hold the sheets together. A head portion is also provided, the head portion comprising an inflatable member having a valve associated therewith for providing inflation or deflation thereof. The head portion has substantially the same extent in the first dimension as the body portion while having a substantially lesser extent in the second dimension than the body portion. The head and body portions are operatively connected together along the extent of the first dimensions thereof (as with stitching). Means are provided affixed to the body portion and associated with at least some of the body portion corners for releasably holding a towel with respect to the body portion, to releasably cover the body portion. The holding means may comprise a plurality of straps with means for mounting the straps with respect to at least some of the body portion corners so that the straps angularly extend from one edge of the body portion to an adjacent substantially perpendicular edge of the body portion adjacent a corner formed by the body portion edges. Straps may be associated with each corner of the body portion, as well as being associated with corners of the head portion remote from the body portion.

The convertible mat heretofore described is preferably used in combination with a bag having carrying straps and defining a volume therewithin for receipt of the beach mat when folded up. The bag has at least one pocket formed therewith exterior of the volume for receipt of the mat so that other items may be readily transported to a desired location along with the mat. Such items may include valuables, suntan oil, a towel for use with the mat, or the like.

According to another aspect of the present invention, a convertible mat and carrying bag combination is provided. The combination includes a mat as heretofore described and a carrying bag. The carrying bag comprises first and second bag walls, fastening means for fastening the walls together along edges and/or portions thereof to define a volume large enough to contain the mat when in a folded condition, and a carrying strap operatively connected to at least one of the bag walls. The second bag wall is formed by a portion of the mat, adjacent one corner of the mat, minimizing the material needed to construct the device, and ensuring that any accessory components carried in an exterior pocket of the bag will remain with the mat when it is unfolded from the bag. Fastening means preferably comprises a zipper having the first row of teeth formed along three edges of the first bag wall and the second row of teeth formed along three portions of the second bag wall corresponding to the edges of the first bag wall, with a slider cooperating with the first and second rows of teeth for joining the rows together. The first bag wall is rigidly attached to the second bag wall along one edge of each of the bag walls, and the second bag wall preferably has a width slightly greater than one-third the width of the mat body portion, providing for ready folding of the mat into a size convenient for transporation to and from an area that which it is to be utilized.

It is the primary object of the present invention to provide a convenient mat assembly for sunbathing or the like. This and other objects of the invention will become clear from an inspection of the detailed description of the invention, and from the appended claims.

BRIEF DESCRIPTION OF THE DRAWINGS

FIG. 1 is a perspective view showing an exemplary mat according to the present invention in unfolded condition, and adjacent a carrying bag therefor;

FIG. 2 is a cross-sectional view of a portion of the mat of FIG. 1 along one edge thereof;

FIG. 3 is a perspective view of an exemplary mat and carrying bag combination according to the present invention with the mat folded up and contained within the bag;

FIG. 4 is a top view of the combination of FIG. 3, with portions of the mat being cut away for clarity, when the bag has been unzipped and the mat unfolded; and FIG. 5 is a bottom view of the structure of FIG. 4.

DETAILED DESCRIPTION OF THE DRAWINGS

An exemplary convertible mat according to the present invention is illustrated generally at 10 in FIG. 1, and shown in association with a carrying bag 12. The mat includes a body portion 14 and a head portion 16, the head and body portions being connected together along a first dimension of each strip 17 by stitching or like means. The body portion 14 is quadrate in plan, having bottom corners 18 and top corners 19. The body portion 14 is made out of a readily foldable, lightweight yet strong sheet material which will not support bacterial life (and will not provide the sanctuary for, nor is it palatable to, rodents or vermin).

FIG. 2 illustrates in cross-section a typical construction of the body portion 14 of mat 10. In this arrangement, the body portion 14 includes first and second sheets 21, 22 respectively of nylon sandwiching therebetween a thin (e.g., one-eighth to one-quarter inch) layer of a plastic foam 23. Means are formed at the edges of all of the layers for holding the layers together along their edges, such as a piece of cloth 24, the overlapping portions of which are stitched at 25 to each other and to the layers 21, 22, and 23. A wide variety of materials may be utilized in the construction. While nylon is a preferred material, materials having the same general durability, strength, bacteria-resistance, and weight properties of nylon are acceptable. The foam layer may be replaced by an inflatable member.

The head portion 16 includes a valve 27 associated therewith for providing inflation or deflation thereof. The head portion also is preferably quadrate in plan, having corners 28 thereof opposite the connection 17 between it and the body portion 14. The head portion may be made of any suitable material allowing inflation, such as first and second layers of vinyl or rubber sealed along all of the edges thereof to each other, and not sealed to each other at central portions thereof.

Means are associated with the body portion 14, and also preferably with the head portion 16, for releasably holding a towel with respect to the body portion to releasably cover the body portion. While the mat 10 can readily be used for sunbathing or the like without any covering, under many circumstances it will be desirable to lay a towel on top of the mat so that the mat need be cleaned less frequently, and/or to absorb moisture from the person laying on the mat. Such towel holding means preferably comprise a plurality of straps 30, and means 31 for mounting the straps with respect to at least some of the body portion 14 corners 18, 19 so that the straps angularly extend from one edge of the body portion to an adjacent substantially perpendicular edge of the body portion, adjacent to a corner (e.g., 18, 19) formed by the body portion edges. As illustrated in FIG. 1, a strap 30 may be associated with each of the corners 18, 19 of the body portion 14, and the attachment means 31 may comprise stitching, adhesive, or any suitable like attaching means. Preferably a pair of straps 30 are also provided associated with the head portion 16 corners 28. A towel may have two corners thereof inserted underneath the straps 30 adjacent the corners 18, and other corners of the towel would be placed under straps 30 either associated with either the corners 19 of body portion 14, or the corners 28 of head portion 16. The towel thus could be releasably held covering the body portion 14 or the body portion 14 and the head portion 16.

As illustrated by fold lines 33 extending in a first dimension A, and fold lines 34 extending in a second dimension B, the mat 10 is readily folded into a compact arrangement which can be disposed within the interior volume of the bag 12. The bag 12, in addition to the interior volume (illustrated generally at 35 in FIG. 1) for containing the mat 10, preferably includes a pocket formed exteriorly of the volume 35. A pocket as illustrated in FIG. 1 is formed by the flap 36 and bag side wall 37. Any number of pockets may, of course, be formed with the bag, and they may be formed with suitable fasteners for holding them shut, such as the snap fastener 38 for holding flap 36 against side wall 37. A carrying strap 39 is also associated with the bag 12 facilitating transport of the bag 12 and contained mat 10. The open top of the bag 12 through which access to the interior volume 35 is gained may be closed by a suitable fastening assembly, such as zipper 40.

In the embodiment of the invention illustrated in FIGS. 3 through 5, the bag is formed integrally with the mat 110. Reference numerals in the FIGS. 3 through 5 embodiment correspond to like reference numerals in the FIG. 1 embodiment, only they contain the numeral "1" before them. Only portions of the mat 110 are illustrated in FIGS. 4 and 5, however, it is to be understood that in the preferred embodiment the portions of the mat 110 not illustrated are comparable to the corresponding portions of the mat 10 illustrated in FIG. 1.

The mat 110 in FIGS. 4 and 5 is shown in combination with the bag 112. The carrying bag 112 comprises first and second wall portions 137 and 145, respectively. A carrying strap 139 and an exterior pocket 136 also are preferably associated with the bag 112. A unique feature of the bag 112 is that the second bag wall 145 thereof is formed by a portion of the mat 110 adjacent one of the corners 118 (see FIG. 5) of the mat.

The bag 112 further comprises fastening means 140 for fastening the walls 137, 145 together along edges and/or portions thereof to define a volume large enough to contain the mat 110 when in a folded condition. The fastening means preferably comprise a zipper, including a first row of teeth 146 formed along at least three edges of the first bag wall 137, a second row of teeth 147 formed along at least three portions (including one wall) of the second bag wall 145 corresponding to the edges of the first bag wall, and a slider 148 cooperating with the first and second rows of teeth 146, 147 for joining the rows together. Preferably, as illustrated in the drawings, the walls 137, 145 are rigidly attached together at 149 along one edge of each, with the zipper means 140 being associated with at least part of the other three edges of the first bag wall 137. For convenience, it is preferred that the second bag wall 145 has a width slightly greater than one-third the width of the mat body portion 114, so that when the mat 110 is folded along fold lines 134 it is readily contained within the bag 112.

It will thus be seen that according to the present invention a convenient and versatile mat and carrying bag combination have been provided.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent devices and combinations.

What is claimed is:

1. A convertible mat and carrying bag combination comprising:

a mat including a body portion of readily foldable lightweight sheet material, and a head portion;

said body portion being generally quadrate in plan, having four corners each formed by substantially perpendicular edges, and being elongated and foldable in first and second substantially perpendicular dimensions of elongation, and comprising: first and second layers of a material selected from the group consisting essentially of nylon, and materials having the same general durability, strength, bacteria-resistance, and weight properties as nylon; a layer of thin plastic foam sandwiched between said first and second layers; and means formed at the edges of all the layers for holding the layers together along their edges;

at least three straps attached to said body portion, one strap associated with each corner of said body portion adjacent said head portion, and one strap associated with a corner of said body portion remote from said head portion;

said head portion being substantially quadrate, having four corners and formed by substantially perpendicular edges, and a pair of straps associated with said head portion, each strap extending from one edge of said head portion to an adjacent substantially perpendicular edge of said head portion adjacent a corner of said head portion remote from an attachment of said head portion to said body portion;

a carrying bag comprising: first and second bag walls, said walls having edges; fastening means for fastening said walls together along edges and/or portions thereof to define a volume large enough to contain said mat when in a folded condition; and a carrying strap operatively connected to at least one of said bag walls; said fastening means comprising zipper means including a first row of teeth formed along at least three edges of said first bag wall, a second row of teeth formed along at least three portions of said second bag wall corresponding to edges of said first bag wall, and a slider cooperating with said first and second rows of teeth for joining the rows together; and said second bag wall being formed by a portion of said mat adjacent one corner of said mat.

2. A convertible mat and carrying bag combination as recited in claim 1 wherein said head portion is inflatable.

3. A convertible mat and carrying bag combination as recited in claim 1 further comprising a pocket formed with one of said carrying bag walls outside of the volume for containing said mat.

4. A convertible mat and carrying bag as recited in claim 1 further comprising means for rigidly attaching said first bag wall to said second bag wall along one edge of each of said bag walls, said zipper means being associated with at least part of three other edges of said first bag wall.

5. A convertible mat and carrying bag combination as recited in claim 1 wherein said second bag wall has a width slightly greater than one-third the width of said mat body portion.

6. A convertible mat in combination with a separate bag having a carrying strap and defining a volume therewithin for receipt of said mat when folded up, and said bag having at least one pocket formed therewith exterior of the volume for receipt of said mat; said mat comprising:

a body portion made of readily foldable lightweight sheet materials which support no bacterial life, said body portion being generally quadrate in plan, having four corners, each formed by substantially perpendicular edges, and being elongated and foldable in first and second substantially perpendicular dimensions of elongation; said body portion comprising: first and second layers of a material selected from the group consisting essentially of nylon, and materials having the same general durability, strength, bacteria-resistance, and weight properties as nylon; and a layer of thin plastic foam sandwiched between said first and second layers; and means formed at the edges of all the layers for holding the layers together along their edges;

a head portion comprising an inflatable member having a valve associated therewith for providing inflation or deflation thereof, said head portion having a similar extent in said first dimension as said body portion, and having a substantially lesser extent in said second dimension as said body portion but extending the majority of the extent of said body portion in said first dimension; said head portion being substantially quadrate, having four corners each formed by substantially perpendicular edges;

means for operatively connecting said head portion to said body portion along the extent of the first dimensions thereof adjacent one end of each;

means affixed to said body portion and associated with at least some of said body portion corners for releasably holding a towel with respect to said body portion, to releasably cover said body portion, comprising: at least three straps, and means for mounting said straps with respect to at least some of said body portion corners so that said straps angularly extend from one edge of said body portion to an adjacent substantially perpendicular edge of said body portion adjacent to a corner formed by said body portion edges, one strap associated with each corner of said body portion adjacent said head portion, and one strap associated with a corner of said body portion remote from said head portion; and a pair of straps associated with said head portion, each strap extending from one edge of said head portion to an adjacent substantially perpendicular edge of said head portion adjacent a corner of said head portion remote from the attachment of said head portion to said body portion.

* * * * *